US011589661B2

(12) United States Patent
Guerreiro et al.

(10) Patent No.: US 11,589,661 B2
(45) Date of Patent: Feb. 28, 2023

(54) HAND HELD APPLIANCE

(71) Applicant: Dyson Technology Limited, Wiltshire (GB)

(72) Inventors: Ilidio Silvestre Guerreiro, Bath (GB); Samuel William Saunders, Swindon (GB); Edward Sebert Maurice Shelton, Swindon (GB); Lolan Naicker, Gloucester (GB)

(73) Assignee: Dyson Technology Limited, Malmesbury (GB)

( * ) Notice: Subject to any disclaimer, the term of this patent is extended or adjusted under 35 U.S.C. 154(b) by 755 days.

(21) Appl. No.: 16/477,438

(22) PCT Filed: Jan. 12, 2017

(86) PCT No.: PCT/GB2017/050079
§ 371 (c)(1),
(2) Date: Jul. 11, 2019

(87) PCT Pub. No.: WO2018/130798
PCT Pub. Date: Jul. 19, 2018

(65) Prior Publication Data

US 2019/0380463 A1 Dec. 19, 2019

(51) Int. Cl.
*A45D 20/12* (2006.01)
*H05B 3/14* (2006.01)
(Continued)

(52) U.S. Cl.
CPC ..... *A45D 20/12* (2013.01); *A45D 1/00* (2013.01); *A45D 2/001* (2013.01); *H05B 3/141* (2013.01);
(Continued)

(58) Field of Classification Search
CPC ..... A45D 20/12; A45D 1/00; A45D 2/001; A45D 20/30; A45D 2001/004; A45D 2020/128; H04B 3/141
(Continued)

(56) References Cited

U.S. PATENT DOCUMENTS 1,755,790 A 4/1930 Nevel
2,261,136 A 11/1941 Brown, Jr.
(Continued)

FOREIGN PATENT DOCUMENTS

CN 1152371 A 6/1997
CN 2314542 4/1999
(Continued)

OTHER PUBLICATIONS

Office Action received for Chinese Patent Application No. 201780083337.5, dated Mar. 14, 2022, 18 pages (10 pages of English Translation and 8 pages of Original Document).
(Continued)

*Primary Examiner* — Stephen M Gravini
(74) *Attorney, Agent, or Firm* — Faegre Drinker Biddle & Reath LLP

(57) ABSTRACT

A hand held appliance including a fluid flow path extending between a fluid inlet and a fluid outlet and a ceramic heater within the fluid flow path wherein the fluid flow path is non-linear and the heater is non-linear. The appliance may include a housing wherein the housing houses the heater and encloses the fluid flow path, and wherein the housing is curved. The heater may be curved. The housing may include a straight section and a curved section and the heater is housed within the curved section. The heater may include at least one heating element comprising a flat ceramic plate and a conductive track. The heating element may be arcuate. The heating element may have a constant curvature.

17 Claims, 8 Drawing Sheets

(51) Int. Cl.
*A45D 1/00* (2006.01)
*A45D 2/00* (2006.01)
*A45D 20/30* (2006.01)

(52) U.S. Cl.
CPC ..... *A45D 20/30* (2013.01); *A45D 2001/004* (2013.01); *A45D 2020/128* (2013.01)

(58) Field of Classification Search
USPC ..... 392/365
See application file for complete search history.

(56) References Cited

U.S. PATENT DOCUMENTS 2,261,137 A 11/1941 Brown, Jr.
2,298,250 A 10/1942 Brown, Jr.
2,578,305 A 12/1951 Huet
2,644,225 A 7/1953 Dietz
2,789,797 A 4/1957 Simpelaar
3,205,560 A 9/1965 Loehlein
3,266,661 A 8/1966 Dates
3,396,458 A 8/1968 Meng et al.
3,848,111 A 11/1974 Brouneus
4,286,377 A * 9/1981 Hurko ..... G01K 7/183 219/466.1
4,352,008 A 9/1982 Hoefer et al.
4,395,619 A * 7/1983 Harigai ..... F24H 3/0423 338/237
4,414,052 A 11/1983 Habata et al.
4,471,213 A 9/1984 Yoshida
4,558,209 A 12/1985 Hess
4,611,238 A 9/1986 Lewis et al.
4,715,430 A 12/1987 Arnold et al.
4,820,903 A 4/1989 Ishida
4,822,980 A * 4/1989 Carbone ..... H05B 3/141 219/205
4,866,248 A 9/1989 Altamore
4,910,382 A 3/1990 Kakuya et al.
5,077,889 A 1/1992 Matsuda et al.
5,177,341 A 1/1993 Balderson
5,243,683 A 9/1993 Yang
5,753,893 A 5/1998 Noda et al.
6,089,314 A 7/2000 Becker et al.
6,735,082 B2 5/2004 Self
6,852,955 B1 2/2005 Golan et al.
7,082,032 B1 7/2006 Barsun et al.
7,335,855 B2 2/2008 von der Lühe et al.
7,355,148 B2 4/2008 Boussier
7,725,011 B2 5/2010 Boussier
3,051,896 A1 11/2011 Wayman
9,273,724 B1 3/2016 Rosenholm et al.
9,338,827 B2 5/2016 Braun et al.
2001/0001416 A1 5/2001 Lee et al.
2004/0139709 A1 7/2004 Illingworth et al.
2004/0244959 A1 12/2004 Chien et al.
2004/0256380 A1 12/2004 Wu
2006/0087398 A1 4/2006 Wu
2006/0289475 A1 12/2006 Tung et al.
2007/0033825 A1* 2/2007 Lo ..... A45D 20/38 34/283
2007/0114219 A1* 5/2007 Rizzuto, Jr. ..... A45D 20/12 219/533
2007/0257022 A1 11/2007 Lin et al.
2008/0179314 A1 7/2008 Colja et al.
2009/0000143 A1* 1/2009 Bazzicalupo ..... A45D 20/12 34/96
2009/0178795 A1 7/2009 Wei
2009/0194519 A1* 8/2009 Funaki ..... F23Q 7/001 219/270
2009/0293300 A1* 12/2009 Merritt ..... H05B 3/16 34/97
2010/0035024 A1 2/2010 Datta et al.
2010/0111510 A1 5/2010 Lo
2011/0079378 A1 4/2011 Bajusz et al.
2011/0209721 A1* 9/2011 Yahnker ..... A45D 20/12 132/271
2011/0232673 A1 9/2011 Crawford
2013/0087549 A1 4/2013 Wang
2014/0290087 A1 10/2014 Weatherly
2014/0290887 A1* 10/2014 Gomi ..... D21B 1/068 162/252
2014/0332023 A1 11/2014 Kaizuka
2016/0220004 A1 8/2016 Moloney et al.
2016/0302548 A1* 10/2016 Yamazaki ..... A61H 23/0263
2016/0360850 A1* 12/2016 Ngo ..... A45D 19/16
2017/0231353 A1 8/2017 Romeo
2018/0271247 A1 9/2018 Marston et al.
2018/0328624 A1 11/2018 Naicker et al.
2019/0357653 A1 11/2019 Guerreiro et al.
2019/0380463 A1* 12/2019 Guerreiro ..... A45D 2/001
2020/0002828 A1 1/2020 Mills
2022/0287429 A1 9/2022 Richmond et al.

FOREIGN PATENT DOCUMENTS

CN 2345907 10/1999
CN 1278745 A 1/2001
CN 2509489 Y 9/2002
CN 2597867 Y 1/2004
CN 2609402 Y 4/2004
CN 27502043 1/2006
CN 2765509 Y 3/2006
CN 1882200 A 12/2006
CN 2917159 Y 6/2007
CN 101008287 A 8/2007
CN 201054804 4/2008
CN 101289328 10/2008
CN 101312603 A 11/2008
CN 101433126 A 5/2009
CN 201700020 U 1/2011
CN 102355758 2/2012
CN 102423184 4/2012
CN 102538547 A 7/2012
CN 102693888 A 9/2012
CN 202501554 U 10/2012
CN 102833896 12/2012
CN 102883483 A 1/2013
CN 103079339 A 5/2013
CN 202918516 U 5/2013
CN 103546998 1/2014
CN 203608982 U 5/2014
CN 103836595 6/2014
CN 104019486 A 9/2014
CN 204757782 U 11/2015
CN 204968132 U 1/2016
CN 105407757 A 3/2016
CN 205624989 U 10/2016
CN 205909491 U 1/2017
CN 106604422 A 4/2017
CN 106859485 A 6/2017
DE 2359478 6/1975
DE 2626409 12/1977
DE 2758078 2/1979
DE 3221868 A1 3/1983
DE 19637431 A1 3/1998
DE 10109734 9/2002
DE 102005026496 7/2006
DE 102008003975 7/2009
EP 0004145 A1 9/1979
EP 0053508 A1 6/1982
EP 0207677 1/1987
EP 0317902 A2 5/1989
EP 0368206 8/1994
EP 0942468 9/1999
EP 1070459 1/2001
EP 1819199 A1 8/2007
EP 1657993 4/2008
EP 2000042 12/2008
EP 3626113 B1 * 2/2021 ..... A01K 13/001
ES 2217989 11/2004
FR 2142816 2/1973
FR 2784274 4/2000
FR 2848685 6/2004

(56) References Cited

FOREIGN PATENT DOCUMENTS

| | | | | |
|---|---|---|---|---|
| FR | 2855709 | | 12/2004 | |
| FR | 2862374 | | 5/2005 | |
| GB | 883547 | | 11/1961 | |
| GB | 1356753 | | 6/1974 | |
| GB | 1539485 | | 1/1979 | |
| GB | 1539485 | A | 1/1979 | |
| GB | 2261351 | | 5/1993 | |
| GN | 87201262 | U | 1/1988 | |
| JP | 52-78838 | | 6/1977 | |
| JP | 52-081378 | U | 6/1977 | |
| JP | S55-23672 | U | 2/1980 | |
| JP | S55-55104 | U | 4/1980 | |
| JP | 57-120047 | | 7/1982 | |
| JP | 63-10563 | | 1/1988 | |
| JP | 2-10683 | | 1/1990 | |
| JP | 2-94384 | | 4/1990 | |
| JP | 2-153868 | | 6/1990 | |
| JP | 2-191303 | | 7/1990 | |
| JP | 3-182088 | | 8/1991 | |
| JP | 4-104493 | | 4/1992 | |
| JP | 4-348701 | | 12/1992 | |
| JP | H7-37095 | Y2 | 8/1995 | |
| JP | H9-213455 | A | 8/1997 | |
| JP | H10-160249 | A | 6/1998 | |
| JP | 10-209357 | A | 8/1998 | |
| JP | 2821749 | B2 | 11/1998 | |
| JP | 11-017080 | A | 1/1999 | |
| JP | 11-097156 | A | 4/1999 | |
| JP | 2001-60784 | | 3/2001 | |
| JP | 2003-068565 | A | 3/2003 | |
| JP | 3117518 | U | 1/2006 | |
| JP | 2015-097167 | A | 5/2015 | |
| JP | 2021166822 | A * | 10/2021 | ..... A45D 1/00 |
| KR | 10-0503262 | | 7/2005 | |
| KR | 10-2012-0019911 | | 3/2012 | |
| KR | 10-2012-0071098 | A | 7/2012 | |
| KR | 2012-0091768 | A | 8/2012 | |
| KR | 10-2012-0113927 | | 10/2012 | |
| KR | 10-1277264 | B1 | 6/2013 | |
| KR | 10-2015-0000234 | | 1/2015 | |
| TW | M307926 | U | 3/2007 | |
| TW | M497245 | U | 3/2015 | |
| WO | 96/11372 | | 4/1996 | |
| WO | 99/22844 | A1 | 5/1999 | |
| WO | 2006/055946 | | 5/2006 | |
| WO | 2007/135644 | | 11/2007 | |
| WO | 2007/135773 | | 11/2007 | |
| WO | 2012/087021 | | 6/2012 | |
| WO | 2017/046559 | A1 | 3/2017 | |
| WO | 2018/130832 | A1 | 7/2018 | |
| WO | WO-2018130798 | A1 * | 7/2018 | ..... A45D 1/00 |

OTHER PUBLICATIONS

International Search Report and Written Opinion dated Aug. 30, 2017, directed to International Application No. PCT/GB2017/050079; 12 pages.

Evaluation Report dated Feb. 5, 2019, directed to CN Application No. 2018206919738; 7 pages.

Examination Report dated Feb. 27, 2020, directed to GB Application No. 1707513.6; 3 pages.

Examination Report No. 1 for standard patent application dated May 15, 2020, directed to AU Application No. 2018265351; 7 pages.

First Office Action and Search Report received for Chinese Patent Application No. 201880006876.3, dated Aug. 31, 2021, 19 pages (11 pages of English Translation and 8 pages of Original Document).

Further Search Report dated Apr. 10, 2018, directed to GB Application No. 1707513.6; 2 pages.

International Search Report and Written Opinion dated Sep. 18, 2018, directed to PCT/GB2018/051028; 17 pages.

International Search Report and Written Opinion received for PCT Patent Application No. PCT/GB2018/050070, dated Jun. 11, 2018, 13 pages.

Notification of Reason for Rejection dated Jul. 29, 2019, directed to JP Application No. 2018-091457; 6 pages.

Notification of Reason for Rejection dated Sep. 3, 2020, directed to JP Application No. 2019-537810; 8 pages.

Office Action dated Oct. 28, 2020, directed to JP Application No. 2019-233802; 4 pages.

Office Action received for Chinese Patent Application No. 201810441952.5, dated Jul. 28, 2021, 21 pages (13 pages of English Translation and 8 pages of Original Document).

Office Action received for European Application No. 18721112, dated Jul. 1, 2021, 6 pages.

Search Report dated Oct. 12, 2017, directed to GB Application No. 1707513.6; 2 pages.

The First Office Action dated Nov. 27, 2020, directed to CN Application No. 201880052111.3; 19 pages.

Written Opinion dated Nov. 12, 2020, directed to SG Application No. 11201909639Y; 7 pages.

Notification of Reason for Rejection dated Sep. 3, 2020, directed to JP Application No. 2019-537761; 7 pages.

Naicker et al., U.S. Office Action dated Oct. 14, 2020, directed to U.S. Appl. No. 15/974,435; 16 pages.

Office Action received for Chinese Patent Application No. 201810441952.5, dated Jan. 29, 2022, 19 pages (12 pages of English Translation and 7 pages of Original Document).

Naicker et al., U.S. Office Action dated Apr. 13, 2020, directed to U.S. Appl. No. 15/974,435; 12 pages.

Naicker et al., U.S. Office Action dated Mar. 18, 2021, directed to U.S. Appl. No. 15/974,435; 11 pages.

Notification of Reason for Refusal dated Dec. 3, 2020, directed to KR Application No. 10-2019-7021630; 10 pages.

Office Action received for Chinese Patent Application No. 201880006876.3, dated Jun. 15, 2022, 22 pages (13 pages of English Translation and 9 pages of Original Document).

Office Action received for Japanese Patent Application No. 2021-116982, dated Jun. 7, 2022, 10 pages (6 pages of English Translation and 4 pages of Original Document).

Office Action received for Japanese Patent Application No. 2021-032303, dated May 17, 2022, 8 pages (4 pages of English Translation and 4 pages of Original Document).

Office Action received for Chinese Patent Application No. 201780083337.5, dated Oct. 8, 2022, 18 pages (10 pages of English Translation and 8 pages of Original Document).

Office Action received for European Patent Application No. 17701007.1, dated Aug. 11, 2022, 6 pages.

Office Action received for European Patent Application No. 18700391.8, dated Aug. 11, 2022, 6 pages.

Office Action received for Chinese Patent Application No. 201780083337.5, dated Aug. 2, 2022, 14 pages (8 pages of English Translation and 6 pages of Original Document).

* cited by examiner

HAND HELD APPLIANCE

REFERENCE TO RELATED APPLICATIONS

This application is a national stage application under 35 USC 371 of International Application No. PCT/GB2017/050079, filed Jan. 12, 2017, the entire contents of which are incorporated herein by reference.

FIELD OF THE INVENTION

This invention relates to a hand held appliance, and in particular a hand held appliance having a heater.

BACKGROUND OF THE INVENTION

Hand held appliances such as hair care appliances and hot air blowers are known. Such appliances are provided with a heater to heat either fluid flowing through the appliance or a surface at which the appliance is directed. Most devices are either in the form of a pistol grip with a handle including switches and a body which houses components such as a fan unit and a heater. Another form is for a tubular housing such as found with hot styling devices. Thus, generally the option is to have fluid and/or heat blowing out of an end of a tubular housing and either to hold onto that housing or be provided with a handle orthogonal to the tubular housing.

This makes the appliance either bulky or sometimes difficult to use as the appliance can be long and/or heavy. A solution to this is two provide a curved form as this reduces the length and can remove some of the bulk. It is known to have a curved hair care appliance with a curved section and then to provide a fan unit in a straight section on one side and the heater in a straight section on the other side. This has the problem that in the curved section fluid can become turbulent resulting in pressure losses and the production of noise. This could be mitigated by turning vanes in the curved section but that adds weight and cost to the appliance. Thus, the inventors have combined the use of a curved hairdryer with the use of a curved ceramic heater so features of the heater can be used to turn and direct the fluid flowing through the curved section and heat this fluid at the same time. This makes the design smaller, quieter and the fluid flowing from the outlet of the appliance can be engineered to exit at any convenient angle regardless of the location of the fluid inlet.

SUMMARY OF THE INVENTION

Thus, according to a first aspect, a hand held appliance comprises a fluid flow path extending between a fluid inlet and a fluid outlet and a ceramic heater within the fluid flow path wherein the fluid flow path is non-linear and the heater is non-linear.

Preferably, the appliance further comprises a housing wherein the housing houses the heater and encloses the fluid flow path, and wherein the housing is curved. In a preferred embodiment the heater is curved.

Thus, according to a second aspect, a hand held appliance comprises a housing, a fluid flow path extending between a fluid inlet and a fluid outlet and a ceramic heater within the fluid flow path wherein the housing houses the heater and encloses the fluid flow path, and wherein the housing is curved and the heater is curved.

Preferably, the housing comprises a straight section and a curved section and the heater is housed within the curved section.

In a preferred embodiment the heater comprises at least one heating element comprising a flat ceramic plate and a conductive track.

Preferably, the heating element is arcuate.

Thus, according to a third embodiment, a housing, a fluid flow path extending between a fluid inlet and a fluid outlet and a ceramic heater within the fluid flow path are provided wherein the housing houses the heater and encloses the fluid flow path, and wherein the housing is curved and the heater is curved.

In a preferred embodiment the heating element has a constant curvature.

Preferably, the heating element curves around an angle of 10° to 170°. In a preferred embodiment the heating element curves around an angle of 80° to 120°.

In a preferred embodiment the heater comprises a heating element and a plurality of fins extending away from the heating element wherein, the plurality of fins dissipate heat from the heating element into the fluid flow path.

Preferably, the heating element is an arcuate flat plate and the plurality of fins extend away from the heating element and are also arcuate.

In a preferred embodiment each one of the plurality of fins follows the same angle of curvature as the heating element.

Preferably, the heater comprises a heating element and a plurality of fins extending away from the heating element wherein, the plurality of fins direct flow of fluid flowing within the heater.

In a preferred embodiment, the plurality of fins comprise a channel extending between adjacent pairs of the plurality of fins and wherein each channel directs flow through the heater.

Preferably, each channel is defined by a surface of a pair of adjacent fins and a portion of a surface of the heating element and wherein, each channel dissipated thermal energy from the heating element into fluid flowing within the fluid flow path.

In a preferred embodiment the housing comprises a straight portion and a curved portion.

Preferably, within the straight portion, the housing houses a fan unit.

In a preferred embodiment, within the straight portion the housing comprises a handle.

Preferably, the appliance is a hair care appliance. It is preferred that the appliance is a hair dryer.

BRIEF DESCRIPTION OF THE DRAWINGS

The invention will now be described with reference to the accompanying drawings, of which.

DETAILED DESCRIPTION OF THE INVENTION

Figure 1:
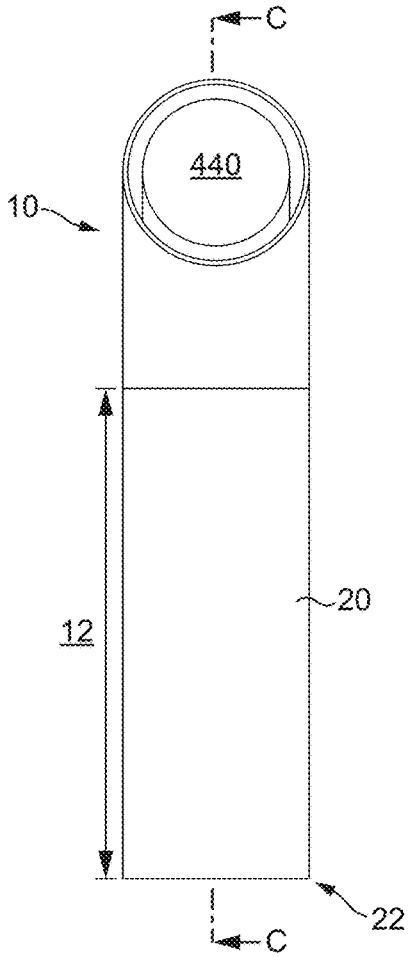
FIG. 1 shows a front view of an appliance according to aspects of the invention.
Figure 2:
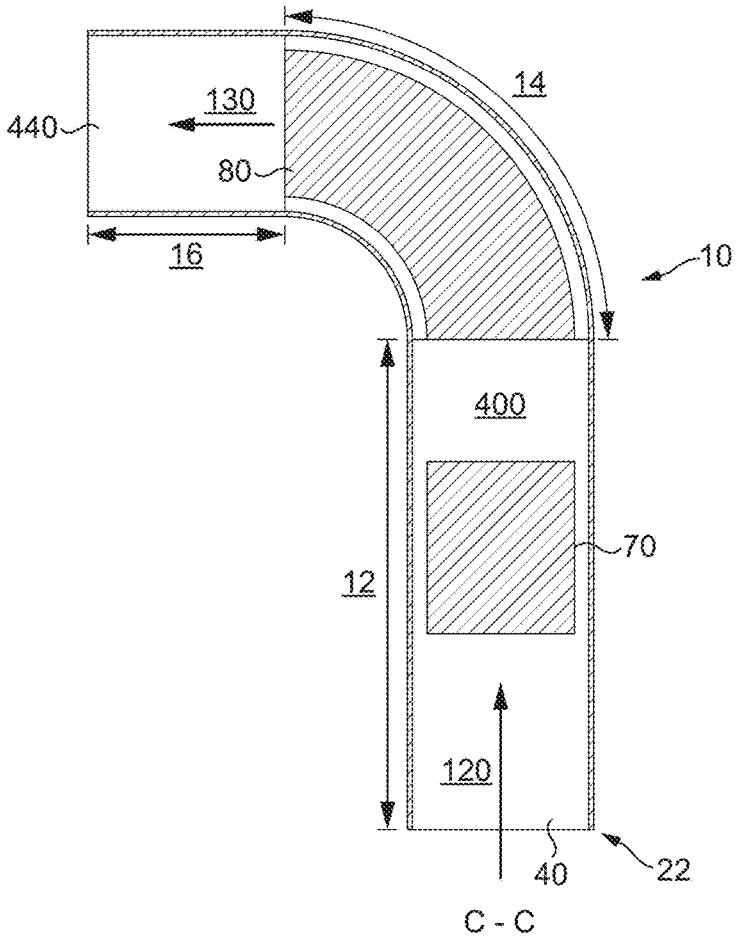
FIG. 2 shows a cross section along line C-C through the appliance of FIG. 1.
Figure 3:
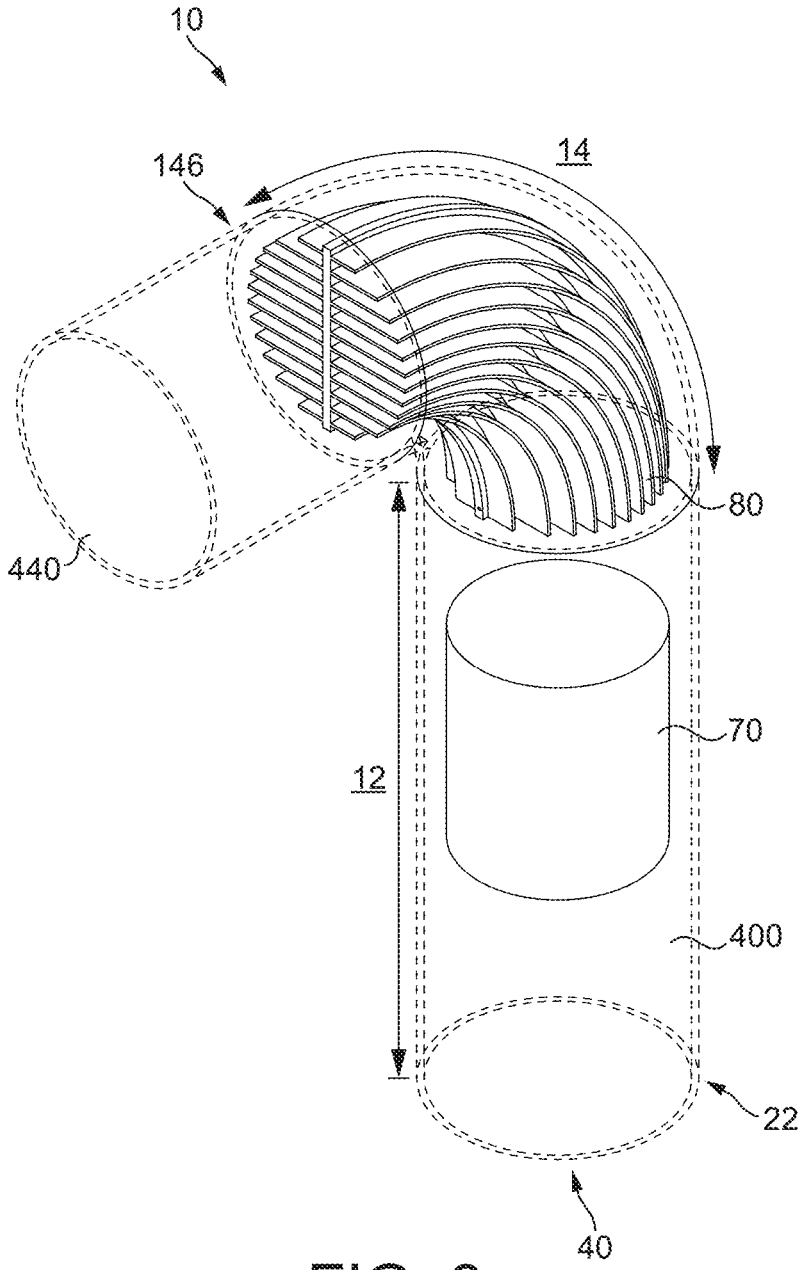
FIG. 3 shows schematically an isometric view of the appliance of FIG. 1.

FIGS. 1, 2, and 3 show an appliance, in this case a hairdryer 10 having a curved outer profile. There a straight section 12 which includes a handle 20 and a curved section 14 which includes a heater 80. A fluid flow path 400 is provided through the appliance from a fluid inlet 40 which is provided at a first end 22 of the straight section 12 to a fluid outlet 440. The fluid outlet 440 is provided adjacent or downstream of the distal end 14*b* of the curved section 14 from the straight section 12. In this embodiment, there is a second straight section 16 provided downstream of the heater 80 or between the curved section 14 and the fluid outlet 440.

The fluid flow path 400 is non-linear and flows through the straight section 12 and the handle 20 in a first direction 120 and exits from the curved section 14 in a second direction 130. At the fluid outlet 440, the fluid flow path 400 has turned 90°, thus the first direction 120 is orthogonal to the second direction 130. However, this is just one example, different degrees of curvature can be used.

The hairdryer 10 can be considered to have an inlet plane extending across the first end 22 of the straight section 12 and an outlet plane extending across the fluid outlet 440 and the inlet plane and the outlet plane are non-parallel.

Figure 4:
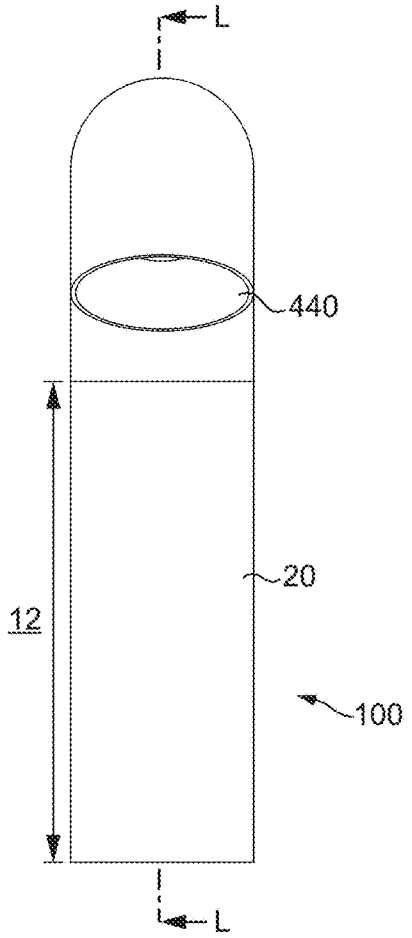
FIG. 4 shows a front view of a further appliance according to aspects of the invention.
Figure 5:
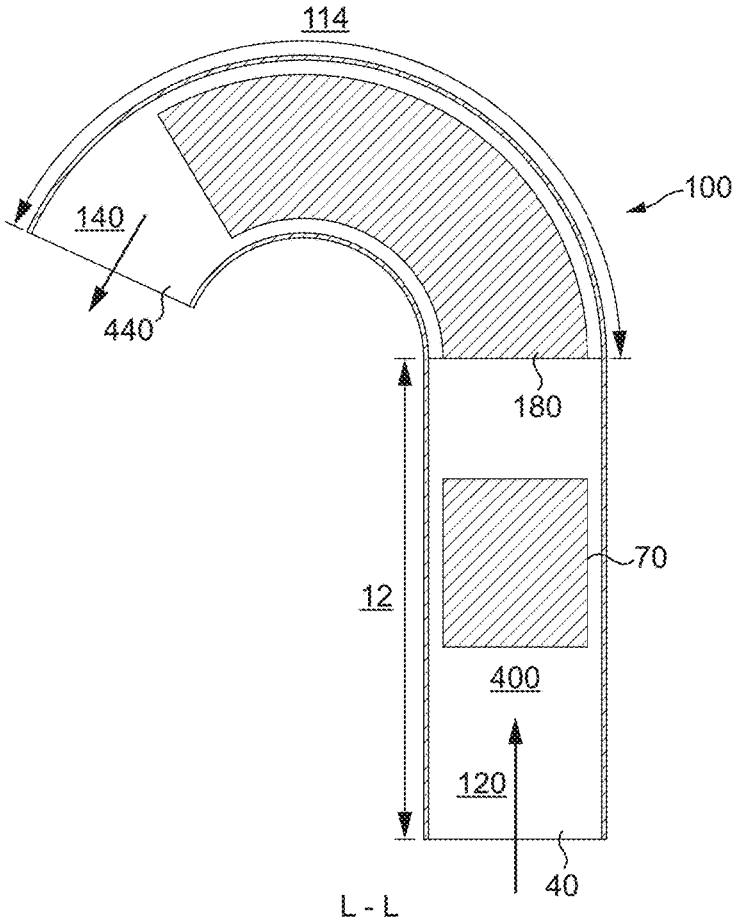
FIG. 5 shows a cross section along line L-L through the appliance of FIG. 4.

A second example of an appliance 100 is shown in FIGS. 4 and 5. In this embodiment, components illustrated and already described in relation to FIGS. 1 to 3 have like reference numerals. In this embodiment, the heater 180 extends further than 90°, thus the first direction 120 is not orthogonal to the section direction 140. The heater 180 extends in an arc of about 120°.

Figure 6A:
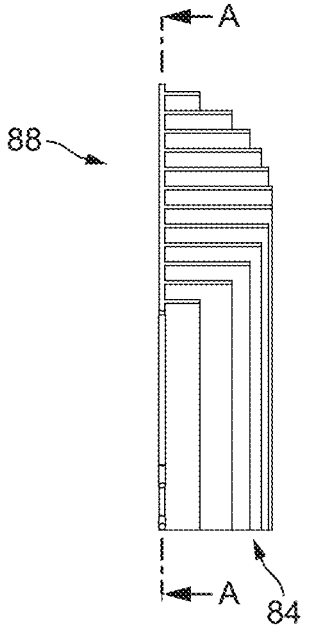
FIG. 6*a* shows a front view of part of a heater according to aspects of the invention.
Figure 6B:
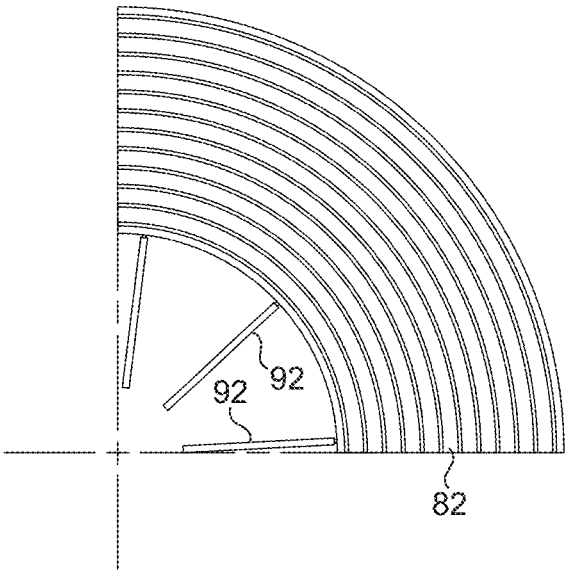
FIG. 6*b* shows a side view of the heater of FIG. 6*a;*
Figure 6C:
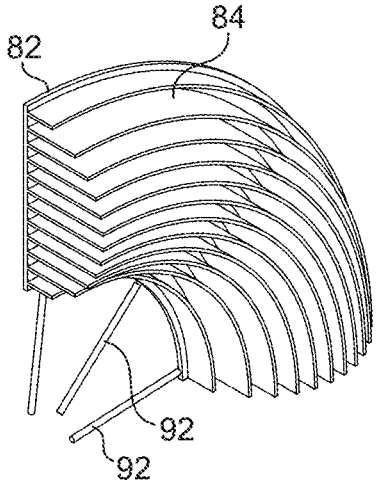
FIG. 6*c* shows an isometric view of the heater of FIG. 6*a;*
Figure 6D:
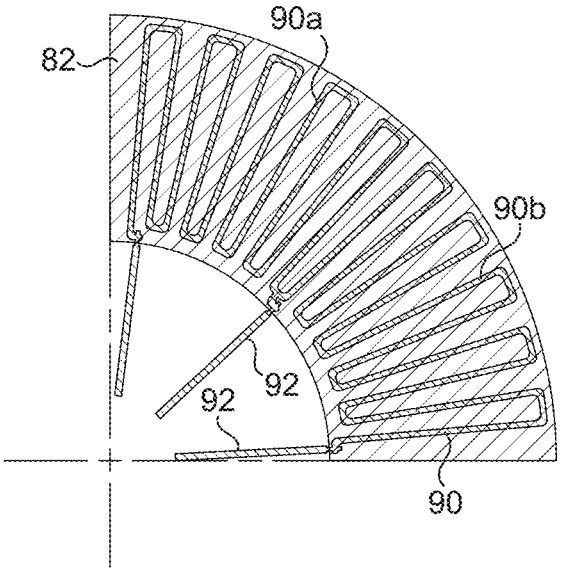
FIG. 6*d* shows a cross section along lone A-A of FIG. 6*a;*

Referring now to FIGS. 6*a* to 6*d* and 7, the heater 80, 180 will be described in more detail. The heater 80, 180 comes in two parts which are subsequently bonded together. FIGS. 6*a* to 6*c* show one of the two parts. The other of the two parts tends to be a mirror image of the one shown. The heater 80, 180 comprises a heating element 88 formed from a flat ceramic plate 82 such as aluminium nitride which has a conductive track 90 typically screen printed onto the flat ceramic plate 82 when in its' green state. Heat is dissipated from the conductive track 90 via fins 84 which extend out from the flat ceramic plate 82 and into the fluid flow path 400. The conductive track 90 is electrically connected to a power source (not shown) via heater connection leads 92. In this example the heater includes two heater tracks 90*a* and 90*b* and there are three leads 92 as the two heater tracks 90*a* and 90*b* share either the live or the neutral connection.

The heaters 80, 180 are single sided unified heaters and there are a few ways of manufacturing them. In one example, the heating element 88 can be fired and then sintered fins 84 can be bonded to the sintered heating element 88 using a bonding paste such as a glass bonding paste. Alternatively, the fins 84 can be attached to the flat ceramic plate 82 in the green state and they can be co-fired as a single unit.

Once each part of the heater has been made the two parts are bonded together.

Figure 7:
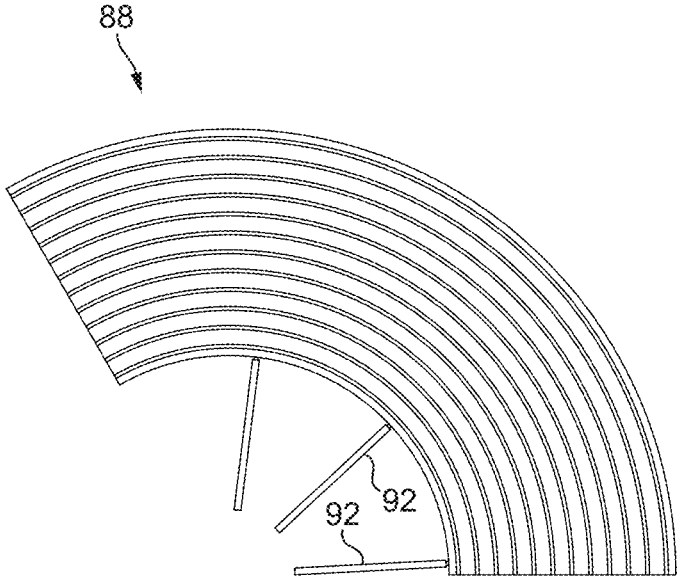
FIG. 7 shows a side view of a different heater.
Figure 8A:
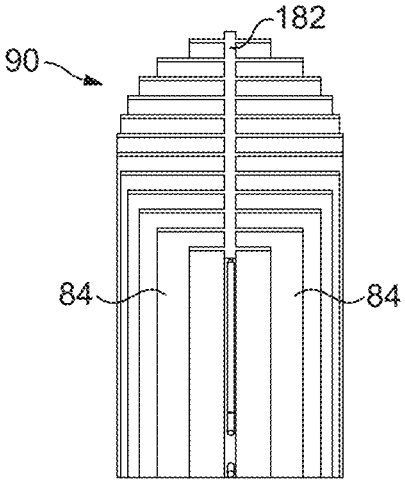
FIG. 8*a* shows a front view of part of another heater according to aspects of the invention.
Figure 8B:
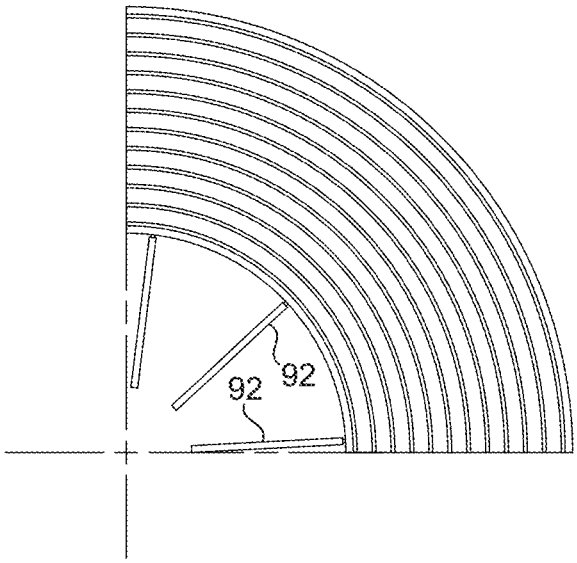
FIG. 8*b* shows a side view of the heater of FIG. 8*a;*
Figure 8C:
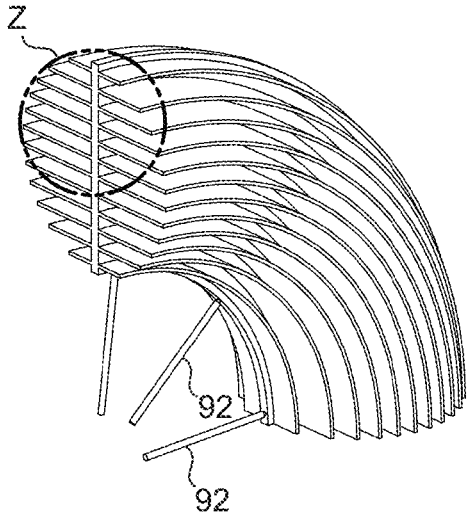
FIG. 8*c* shows an isometric view of the heater of FIG. 8*a;*
Figure 8D:
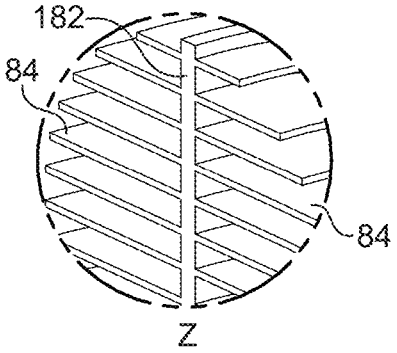
FIG. 8*d* shows an enlarged view of portion Z of FIG. 8*c;*

FIG. 7, shows the heater 180 having a 120° bend or turn whereas FIGS. 6*a* to 6*d* show the heater having a 90° bend or turn.

FIGS. 8*a* to 8*d*, 9*a* and 9*b* show another heater variation 90, 190. This heater is formed as a double sided heater 90. In this example the conductive track 90 is embedded in a flat ceramic plate 182 which has fins 84 attached to both sides. This eliminates the need for a bond between the two parts of the heater 80, 180 described with respect to FIGS. 6*a* to 6*d* and 7. The flat ceramic plate 182 can be fired and sintered fins 84 subsequently attached using a bonding paste or all the fins 84 can be attached to the flat ceramic plate 182 in the green state and the whole heater 90 fired to produce the final article.

Figure 9A:
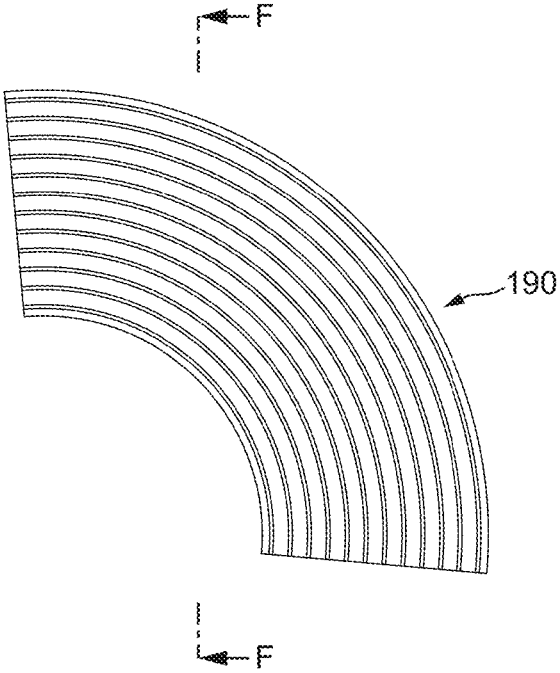
FIG. 9*a* shows a side view of another heater.
Figure 9B:
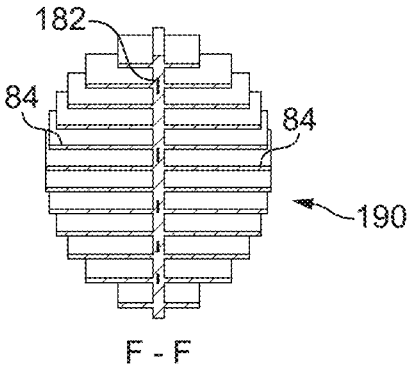
FIG. 9*b* shows a cross section along line F-F through the appliance of FIG. 9*a;*

FIGS. 9*a* and 9*b* show the heater 190 having a 110° bend or turn whereas FIGS. 8*a* to 8*d* show the heater having a 90° bend or turn.

Figure 10A:
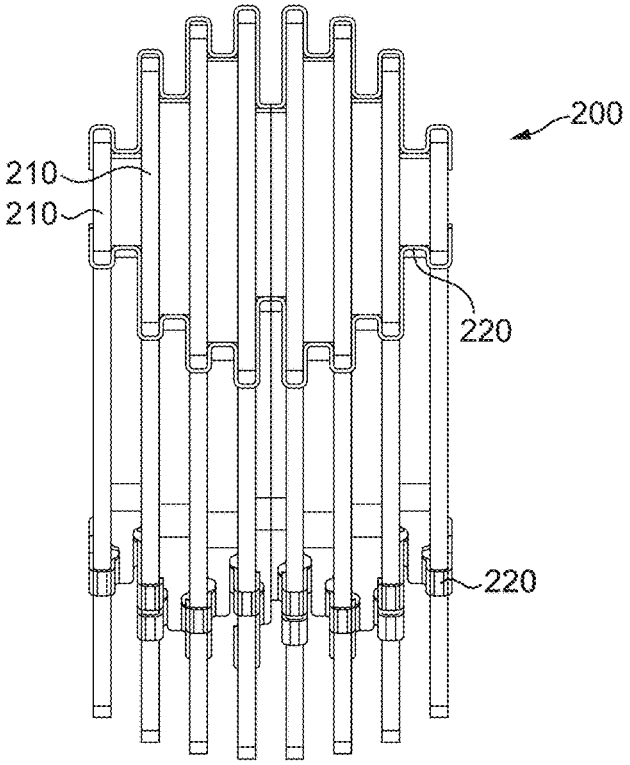
FIG. 10*a* shows a front view of part of another heater according to aspects of the invention.
Figure 10B:
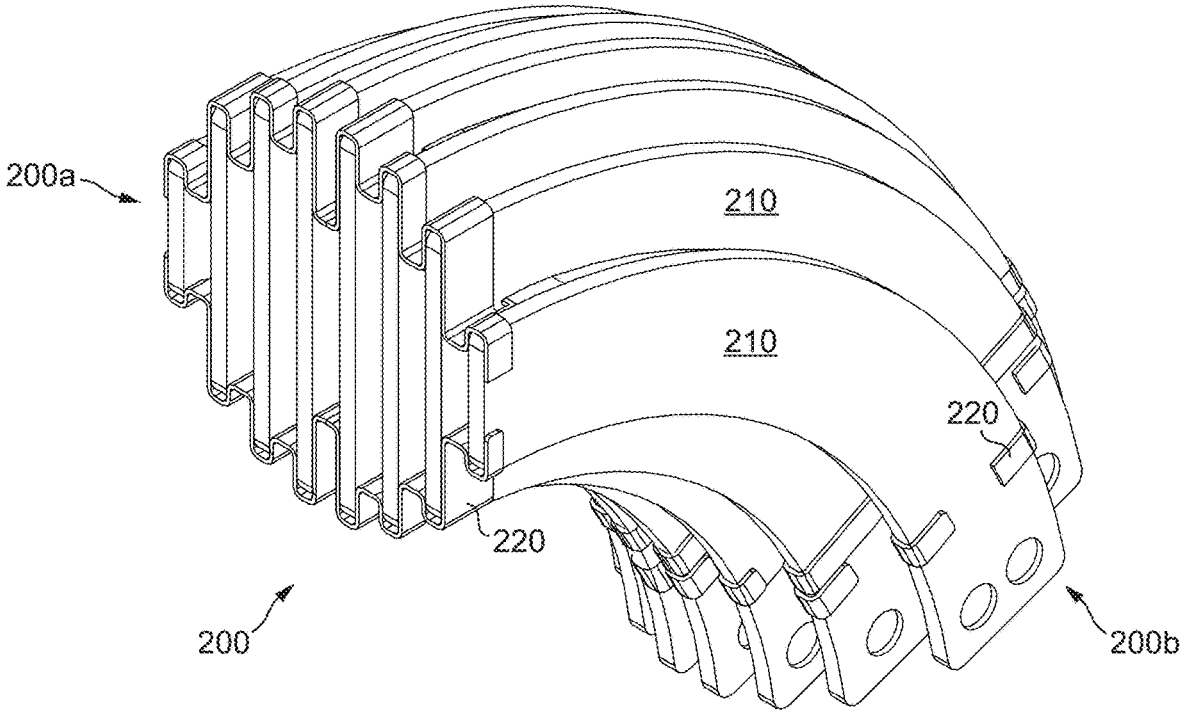
FIG. 10*b* shows an isometric view of the heater of FIG. 10*a;*.
Figure 10C:
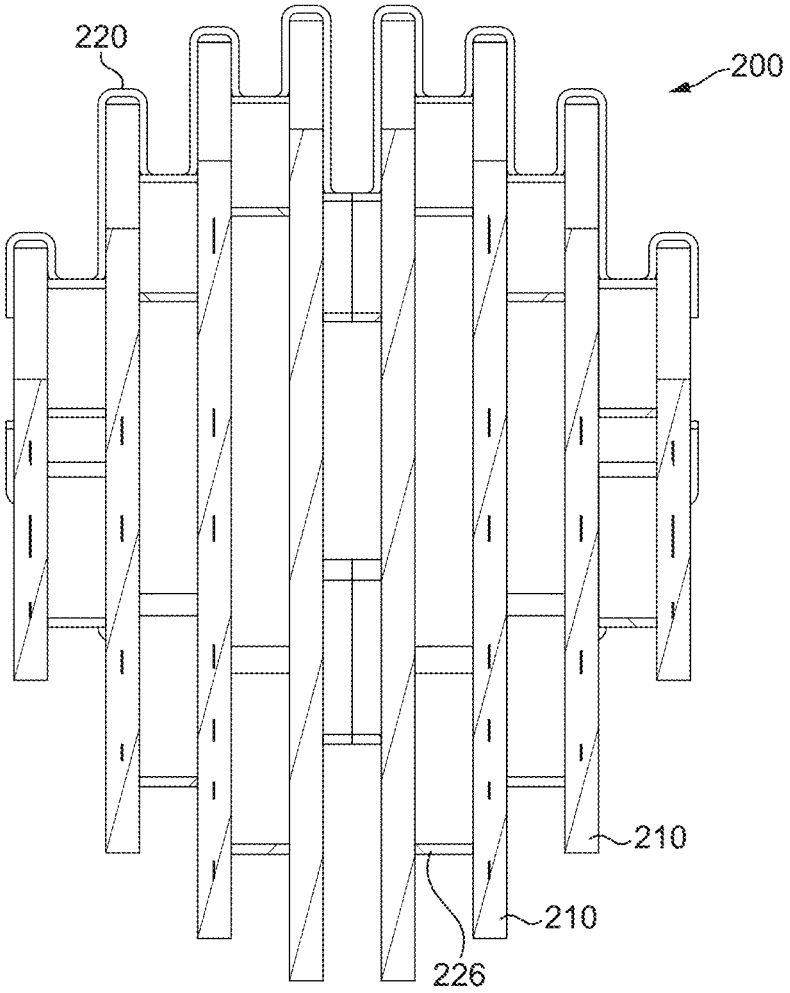
FIG. 10*c* shows a cross section along line G-G through the appliance of FIG. 10*a.*

FIGS. 10*a* to 10*c* show another heater 200 variant. In this embodiment, a multitude of discrete flat ceramic plates 210 are used to provide the heat. As previously described, each of the discrete ceramic plates 210 includes a conductive track (not shown) and are held together with a scaffold formed from stamped metal sheets 220. The flat ceramic plates 210 are held at or near each end 200*a* and 200*b* of the heater 200 to maintain spacing between the flat ceramic plates 210 allowing fluid to flow between adjacent flat ceramic plates.

In all the examples shown, a three dimensional heater has been produced using a two dimensional heating element 88.

The examples showing fins 84 have an added benefit that the fins are used to dissipate heat from the heating element 88 and as they follow the curve of the heater 80, 90, 180, 190 the fins 84 assist in turning flow around the curve, reducing turbulence which reduces pressure losses through the heater as the fluid is turned from a first direction 120 to a second direction 130, 140 and also reduces the production of noise.

In the example without fins, as shown in FIGS. 10*a* to 10*c*, the plurality of heater elements 210 direct the flow of fluid flowing through the heater 200 by providing a longitudinal split through the fluid flow path. In this embodiment, as there are a plurality of heating elements 210 separate fins are not required for heat dissipation as instead of the heating element 80 having two surfaces available for thermal exchange with the fluid flow path, there are two times as many surfaces as there are heating elements.

Thus, thermal exchange from the heater to fluid flowing in the fluid flow path can be achieved by increasing the available surface of the heating element or by providing a cooling feature such as the fins which wick heat from the heating element towards the tips of the fins due to a thermal gradient, this heat is then exchanged with fluid that flows passed the fins which increases the thermal gradient causing more heat to be drawn along the fins.

In order to enable any angle of exit from the fluid outlet, the appliance is provided with a housing that extends beyond the heater. In FIG. 2, this piece of the housing 16 is straight and fluid flowing out of the heater 80 continues in the same direction. However, this piece of the housing does not need to be straight it could be curved to allow exit from a different angle or even be adjustable by a user to enable a range of different exit angles to be used.

The conductive track can be formed from two tracks as described, however one track can be used or more than two. Use of a single track may limit the temperatures setting available to the user whereas multiple tracks enable different wattage to be turned on and off giving more levels of temperature and more accurate control. Different wattage can be achieved by a number of different identical tracks or each track could be rated to a different number of watts. Also, although three connection points are shown, each track could have individual connection points or a different sharing arrangement could be used.

Suitable ceramic materials include aluminium nitride, aluminium oxide and silicon nitride.

According to various aspects, appliances have been described above as having a fluid flow and this has been used instead of air flow as it is known to use hair care appliances with refillable containers of serums or even water to hydrate hair as it is being styled. Indeed it may utilise a different combination of gases or gas and can include additives to improve performance of the appliance or the impact the appliance has on an object the output is directed at for example, hair and the styling of that hair.

The invention has been described in detail with respect to a hairdryer however, it is applicable to any appliance that draws in a fluid and directs the outflow of that fluid from the appliance.

According to various aspects, appliances can be used with or without a heater; the action of the outflow of fluid at high velocity has a drying effect.

According to various aspects, appliances have been described without discussion of any attachment such as a concentrating nozzle or a diffuser however, it would be feasible to use one of these known types of attachment in order to focus the exiting fluid or direct the fluid flow differently to how it exits the appliance without any such attachment.

The invention is not limited to the detailed description given above. Variations will be apparent to the person skilled in the art.

The invention claimed is:

1. A hand held appliance comprising a housing, a fluid flow path extending between a fluid inlet and a fluid outlet and a ceramic heater within the fluid flow path wherein the housing houses the heater and encloses the fluid flow path, and wherein the housing is curved and the heater is curved, wherein the housing comprises a straight section and a curved section, the curved section being a curved elbow, and the heater is housed within the curved elbow, wherein the heater comprises a heating element and a plurality of fins extending away from the heating element and wherein the plurality of fins direct flow of fluid flowing within the heater.

2. The appliance of claim 1, wherein the heater comprises at least one heating element comprising a flat ceramic plate and a conductive track.

3. The appliance of claim 2, wherein the heating element is arcuate.

4. The appliance of claim 3, wherein the heating element has a constant curvature.

5. The appliance of claim 3, wherein the curved elbow and the heating element curve around an angle of 10° to 170°.

6. The appliance of claim 5, wherein the curved elbow and the heating element curve around an angle of 80° to 120°.

7. The appliance of claim 1, wherein the heater comprises a heating element and a plurality of fins extending away from the heating element wherein, the plurality of fins dissipate heat from the heating element into the fluid flow path.

8. The appliance of claim 7, wherein the heating element is an arcuate flat plate and the plurality of fins extend away from the heating element and are also arcuate.

9. The appliance of claim 8, wherein each one of the plurality of fins follows the same angle of curvature as the heating element.

10. The appliance of claim 1, wherein the plurality of fins comprise a channel extending between adjacent pairs of the plurality of fins and wherein each channel directs flow through the heater.

11. The appliance of claim 10, wherein each channel is defined by a surface of a pair of adjacent fins and a portion of a surface of the heating element and wherein, each channel dissipates thermal energy from the heating element into fluid flowing within the fluid flow path.

12. The appliance of claim 1, wherein within the straight section, the housing houses a fan unit.

13. The appliance of claim 1, wherein within the straight section the housing comprises a handle.

14. A hand held appliance comprising a housing, a fluid flow path extending between a fluid inlet and a fluid outlet and a ceramic heater within the fluid flow path, wherein the housing houses the heater and encloses the fluid flow path, wherein the housing is curved and the heater is curved, the heater comprises a curved heating element and a plurality of curved fins extending away from the curved heating element, wherein the plurality of curved fins direct flow of fluid flowing within the heater, and wherein the plurality of curved fins dissipate heat from the curved heating element into the fluid flow path.

15. A housing enclosing a fluid flow path extending between a fluid inlet and a fluid outlet and housing a ceramic heater located within the fluid flow path, wherein the housing is curved and the heater is curved, the heater comprises a heating element and a plurality of fins extending away from the heating element, wherein the plurality of fins direct flow of fluid flowing within the heater, and wherein the plurality of fins dissipate heat from the heating element into the fluid flow path.

16. The appliance of claim 1, wherein the appliance is a hair care appliance.

17. The appliance of claim 1, wherein the appliance is a hairdryer.

* * * * *